US005904077A

United States Patent [19]

Wright et al.

[11] Patent Number: 5,904,077

[45] Date of Patent: May 18, 1999

[54] DOUBLE-ENDED FLEX HANDLE WRENCH

[75] Inventors: Richard B. Wright; Kenneth Milligan, both of Akron, Ohio

[73] Assignee: Wright Tool Company, Barberton, Ohio

[21] Appl. No.: 08/399,836

[22] Filed: Mar. 7, 1995

[51] Int. Cl.[6] ..... B25B 23/16

[52] U.S. Cl. ..... 81/177.9; 81/177.85; 81/177.7

[58] Field of Search ..... 81/177.9, 177.1, 81/177.8, 177.5, 177.85, 177.7

[56] References Cited

U.S. PATENT DOCUMENTS

| | | | |
|---|---|---|---|
| 1,407,110 | 2/1922 | Wutke . | |
| 1,646,140 | 10/1927 | Dickie . | |
| 2,294,510 | 9/1942 | Nakano | 81/177.7 |
| 2,951,405 | 9/1960 | Engquist . | |
| 2,978,938 | 4/1961 | Nalley | 81/177.8 |
| 2,987,334 | 6/1961 | Wenpling | 81/177.75 |
| 4,084,456 | 4/1978 | Pasbrig | 81/177.8 |
| 5,199,335 | 4/1993 | Arnold et al. | 81/177.8 |

*Primary Examiner*—Willis Little
*Attorney, Agent, or Firm*—D. Peter Hochberg

[57] ABSTRACT

A double-ended flex-handle wrench having a pivotable tool head at each end thereof, the tool head having a locking-type retaining device for locking a gripping member to the tool head.

2 Claims, 4 Drawing Sheets

DOUBLE-ENDED FLEX HANDLE WRENCH

FIELD OF THE INVENTION

The present invention relates generally to a double-ended wrench having a flex handle. More particularly, the present invention relates to a double-ended flex handle wrench having at each end thereof a pivotable mounting member including a locking-type retaining device.

BACKGROUND OF THE INVENTION

A large variety of wrenches have been developed, such wrenches having specialized features adapted for particular working conditions. Frequently, a particular working condition requires a plurality of gripping members, each gripping member being a different type and/or size. "Types" of gripping members include 6, 8, and 12-point regular-depth sockets; 6, 8, and 12-point deep-depth sockets; crowfoot wrenches; hex bit sockets; phillips screwdriver bit sockets; slotted screwdriver bit sockets; and TORX® bit sockets. Typical "sizes" for gripping members include standard (i.e., English) sizes, and metric sizes. Standard sizes are usually indicated in inches, while metric sizes are usually indicated in millimeters.

With prior art single-ended flex handle wrenches, a user can only have one type and/or size of gripping member readily available. Accordingly, prior art wrenches are less convenient and less versatile. For instance, in an assembly line used to assemble a device having bolts, screw heads, nuts or the like requiring gripping members of differing types and/or sizes, a wrench adapted to simultaneously receive multiple gripping members is advantageous.

The prior art also fails to provide a detent that securely holds a pivotable mounting member in a position parallel to the wrench handle (i.e., 0°) or in a position perpendicular to the wrench handle (i.e., +/−90°). In this respect, prior art continuous friction devices fail to hold the mounting member in the desired position when a significant force is applied to the wrench handle. A detent which securely holds the mounting member in the +90°, 0° and −90° positions when a significant force is applied to the wrench handle, allows a user to more easily and safely operate the wrench. In particular, a detent which securely holds the mounting member in the desired position makes it easier for the user to operate the wrench with one hand while stretched outward.

In order to secure a gripping member to the mounting member, prior art wrenches use a spring-loaded non-locking retaining device. Bumping or catching the wrench may cause the gripping member to be released from the mounting member unexpectedly. Accidental release of the gripping member is particularly dangerous when the wrench is being used at a significant height (e.g., overhead or from the top of a ladder). In this respect, sudden release of the gripping member could cause possible injury to the user or a bystander, or damage to an object below. Accordingly, a retaining device which does not weaken the structural integrity of the mounting member, which securely locks a gripping member to a mounting member, and which prevents accidental release of the gripping member, provides a stronger, longer-lasting and safer wrench.

The prior art also fails to provide a wrench having an ergonomic shape. In this respect, a wrench handle shape is needed that allows the user to obtain a firmer grip on the wrench, thus providing better control and maneuverability of the wrench, both of which are particularly important for overhead use. Moreover, a wrench handle is needed that allows the user to adequately control and maneuver the wrench with the use of only one hand.

The present invention overcomes these and other drawbacks of prior art devices.

SUMMARY OF THE INVENTION

It is an object of the present invention to provide a double-ended wrench having a pair of mounting members that can accept interchangeably a variety of different types and sizes of gripping members.

It is another object of the present invention to provide a double-ended wrench having a spring-loaded detent which securely holds a mounting member in a position parallel or perpendicular to the longitudinal axis of the wrench handle.

It is another object of the present invention to provide a double-ended wrench having a locking-type retaining device which is operated from the outer end of the mounting member.

It is still another object of the present invention to provide a double-ended wrench having an ergonomically shaped handle that allows the user to securely grip and operate the wrench using only one hand.

These and other objects and advantages will become apparent from the following description of a preferred embodiment of the invention taken together with the accompanying drawings.

BRIEF DESCRIPTION OF THE DRAWINGS

The invention may take physical form in certain parts and arrangement of parts, an preferred embodiment of which will be described in detail in the specification and illustrated in the accompanying drawings which form a part hereof and wherein.

DETAILED DESCRIPTION OF THE PREFERRED EMBODIMENT

Figure 1:
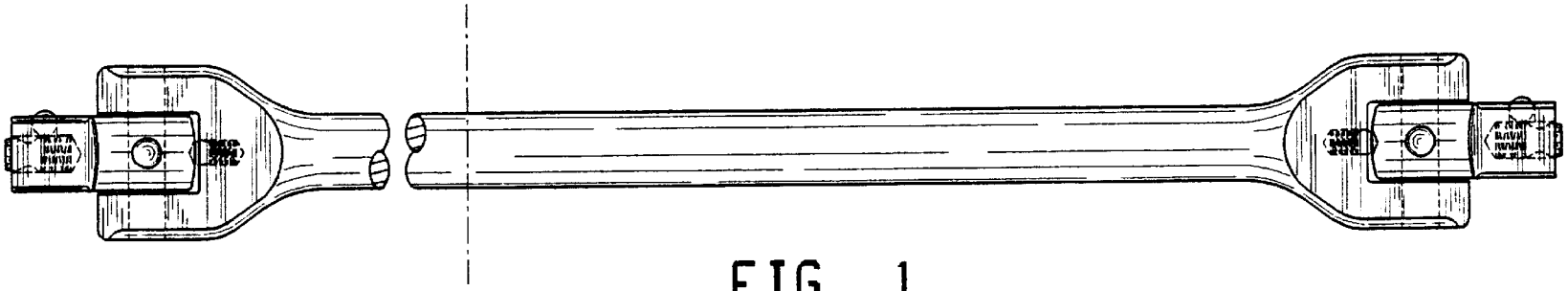
FIG. 1 is a top plan view of a double-ended wrench illustrating a preferred embodiment of the present invention.
Figure 2:
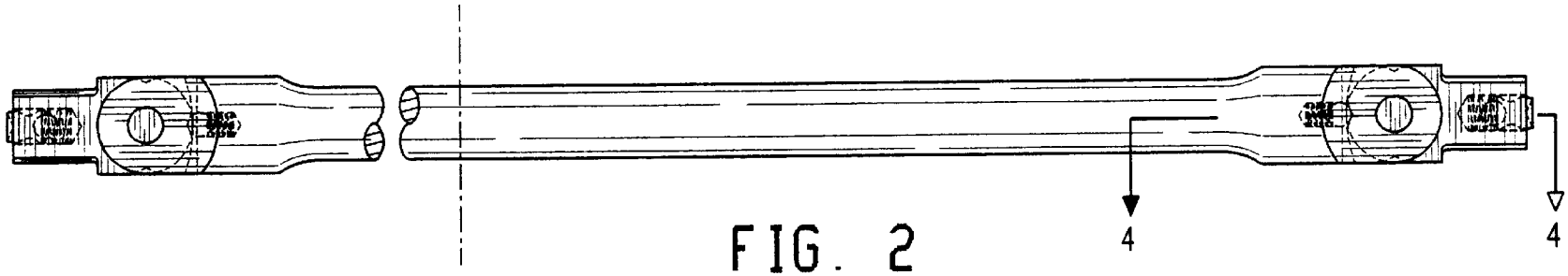
FIG. 2 is a side plan view of the double-ended wrench shown in FIG. 1.

Referring now to the drawings wherein the showings are for the purpose of illustrating the preferred embodiment of the invention only, and not for the purpose of limiting same, FIGS. 1 and 2 show a double-ended wrench 10 having a handle 20 and pivotable mounting members 50 at each end thereof.

Double-ended wrench 10 will be described with respect to only one end thereof, it being understood that such description applies equally to the other end of wrench 10.

Handle 20 is generally comprised of an elongated portion 22 and forked ends 30. Forked ends 30 each have an arm 32 and an arm 34 which form a slot 36 for receiving a mounting member 50. A bridge portion 35 connects arms 32 and 34. A bore 38 is formed in each of arms 32 and 34. Bores 38 extend transverse to the longitudinal axis of handle 20.

A longitudinal cavity 40 extends inward at the center of slot 36. A ball 42 is spring-loaded by spring 44 within the cavity. Ball 42 and spring 44 form a spring-loaded detent means which holds pivotable mounting member 50 in a selected position, as will be discussed below. In a preferred embodiment, handle 20 has a length in the range of approximately 12 inches to 24 inches.

Mounting member 50 is generally comprised of a support member 60 and a stud 70 in the form of a male square. In a preferred embodiment of the present invention, support member 60 is formed with three cavities 64, each cavity at 90° increments. Cavities 64 are dimensioned to receive therein spring-loaded ball 42. A bore 62 extends through the center of support member 60. Bore 62 is aligned with bores 38 in arms 32 and 34 when mounting member 50 is properly positioned within slot 36. Bore 62 and bores 38 receive a pivot pin 52, which is described below.

Figure 3:
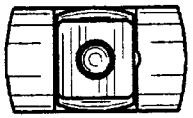
FIG. 3 is an end view of the double-ended wrench shown in FIG. 1.
Figure 4:
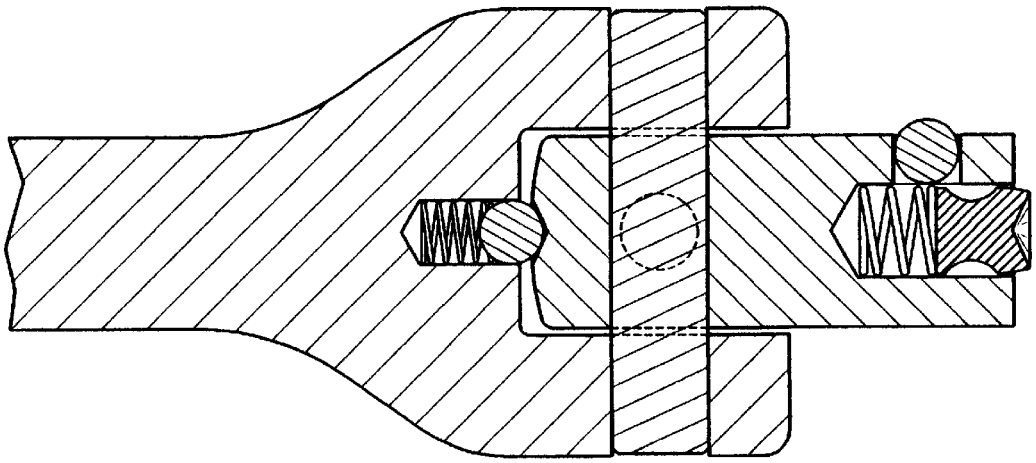
FIG. 4 is a sectional view taken along 4—4 of FIG. 2 showing a stud with a retaining means in a locked position.
Figure 5:
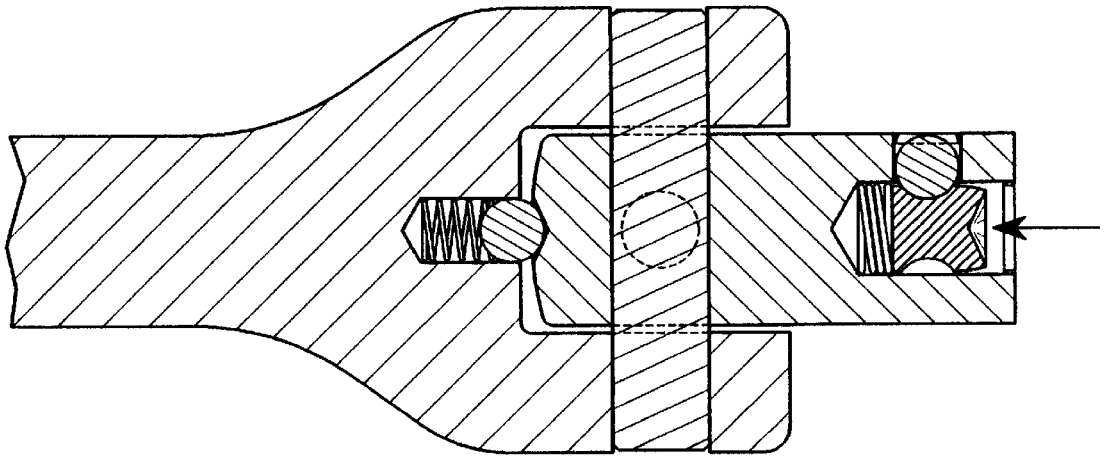
FIG. 5 is a sectional view taken along 4—4 of FIG. 2 showing a stud with a retaining means in an unlocked position.
Figure 6:
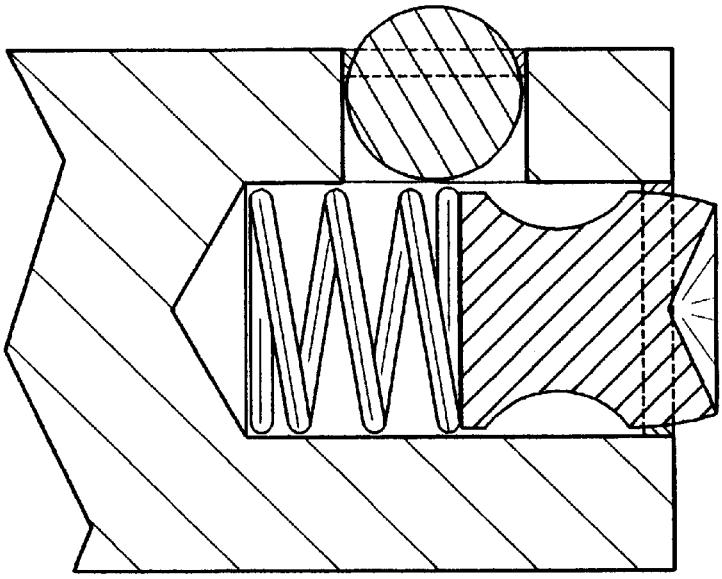
FIG. 6 is a magnified view of a stud with a retaining means in a locked position.

Stud 70 has a generally square shape adapted to receive a conventional gripping member. Preferably, stud 70 is in the shape of ¼", ½" or ¾" male square. The outer end of stud 70 has an elongated recess 72 extending in the longitudinal direction of mounting member 50. Recess 72 is dimensioned to receive a catch head 76 that is spring-loaded by a spring 74. At the outer end of recess 72 a narrow portion 86 is formed to prevent catch head 76 from being released from recess 72 (as shown in FIGS. 3–5). A hole 84 is formed in stud 70, transverse to recess 72, to receive a locking ball 82. A narrow portion 88 is formed at the outer end of hole 84 to prevent locking ball 82 from being released from hole 84. An annular recess 78 is formed around the periphery of catch head 76 for engagement with ball 82 (shown in FIGS. 4–7). The forward face 80 of catch head 76 is generally conical inward, and extends through recess 72, best shown in FIG. 6, to make contact with a locking portion (e.g., a lock hole or groove) of a gripping member (not shown). The diameter of catch head 76 decreases from annular recess 78 to forward face 80. Accordingly, a portion of catch head 76 can extend through narrow portion 86 of recess 72, as shown in FIG. 6. Together, catch head 76, spring 74, and ball 82 comprise a retaining means.

Alternatively, the retention means may be comprised of a locking screw retaining device. The locking screw retaining device is comprised of a hollow bead set screw in the outer end of stud 70, with a conical point which urges a ball or plunger outward to engage with the locking portion of the gripping member.

As stated above, pivot pin 52 extends through bore 62 of stud 70 and bores 38 of arms 32 and 34, to pivotally connect mounting member 50 with forked end 30. Pivot pin 52 has expanded grooves (3) parallel to its axis to keep it from sliding out from bores 38 and bore 62.

Referring now to FIGS. 4 and 6, there is shown a sectional view of one end of wrench 10, taken along 4—4 of FIG. 2. Mounting member 50 is shown in a 0° position and the retaining means of gripping stud 70 is shown in a locked position. Spring 44 of the detent means exerts a force on ball 42. Accordingly, ball 42 engages with cavity 64 to hold mounting member 50 firmly in the desired position. To move mounting member 50 to the +90° or −90° positions, the force of spring 44 must be overcome, such that ball 42 is urged out of cavity 64.

Turning now to stud 70, spring 74 of the retaining means exerts a force on catch head 76, tending to urge the end portion of catch head 76 out of recess 72. In doing so, ball 82 is also pushed out of recess 72. Narrow portion 86 of stud 70 prevents catch head 76 from being released from elongated recess 72.

Figure 7:
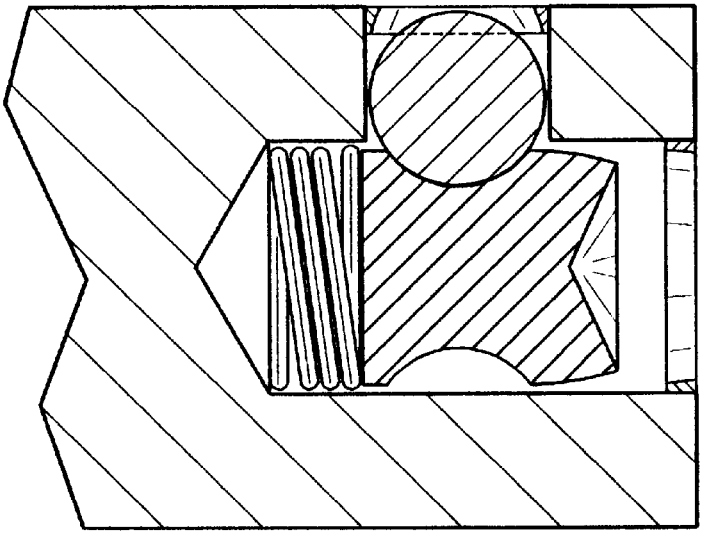
FIG. 7 is a magnified view of a stud with a retaining means in an unlocked position.

To mount a gripping member (not shown) to stud 70, a force must be applied to forward face 80 tending to cause catch head 76 to move further into elongated recess 72 until ball 82 is positioned within annular recess 78. At this point, mounting member 50 will be in an unlocked position as shown in FIGS. 5 and 7. Once the gripping member is positioned onto stud 70 in its operational position, the mounting member will return to its locked position as shown in FIG. 4. In this respect, ball 82 extends through hole 84 to engage with the surface of a locking hole or groove in the gripping member. To remove a gripping member from stud 70, the force exerted by spring 74 must be overcome so that ball 82 is again positioned within annular recess 78.

Figure 8:
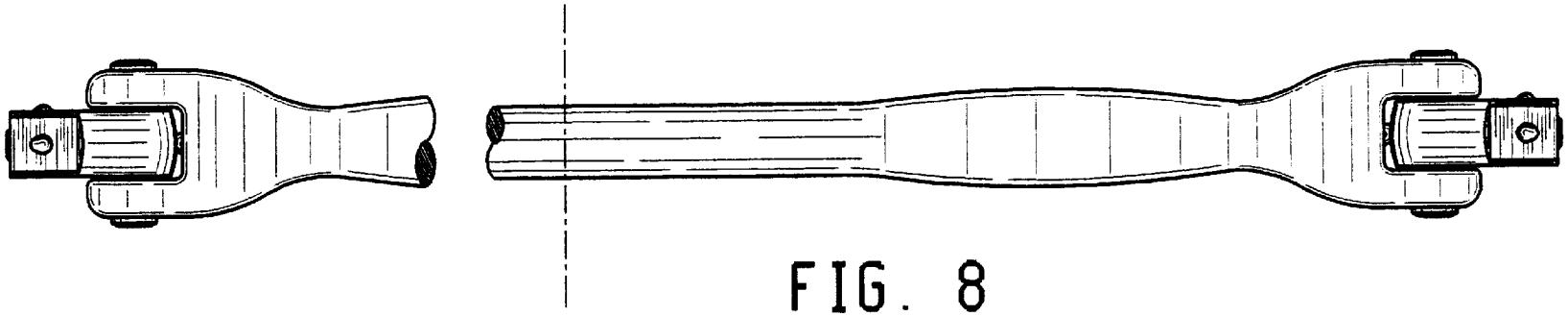
FIG. 8 is a top plan view of a double-ended wrench illustrating a second preferred embodiment of the present invention.
Figure 9:
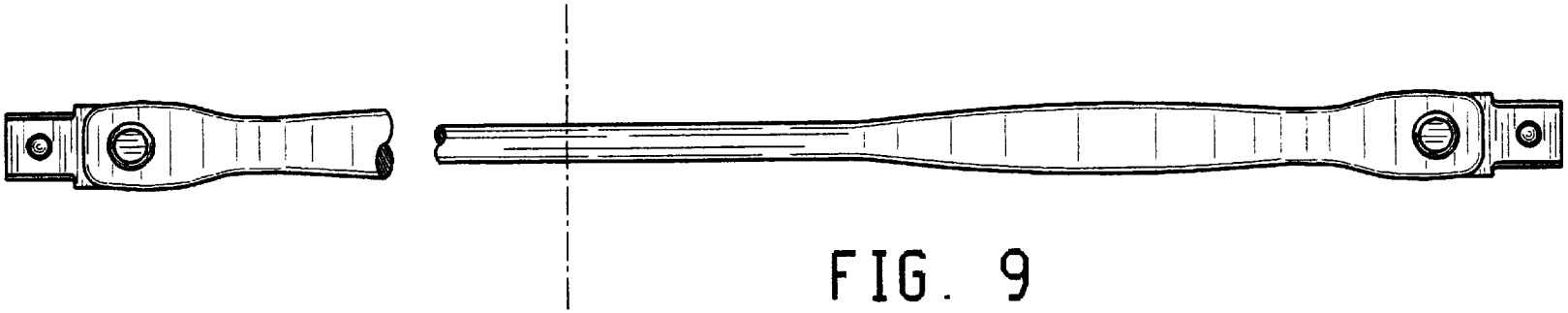
FIG. 9 is a side plan view of the double-ended wrench shown in FIG. 8.
Figure 10:
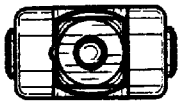
FIG. 10 is an end view of the double-ended wrench shown in FIG. 8.

FIGS. 8–10 show another preferred embodiment of the present invention. A double-ended wrench 10' includes the same mounting member 50 as in the embodiment discussed above. However, the embodiment shown in FIGS. 8–10 comprises a handle 20' having bulbous portions 100. Bulbous portions 100 are positioned near forked ends 30 to provide additional gripping surfaces for controlling and maneuvering wrench 10'.

The foregoing description provides specific embodiments of the present invention. It should be appreciated that these embodiments are described for the purposes of illustration only and that numerous alterations and modifications may be practiced by those skilled in the art without departing from the spirit and scope of the invention.

Having described the invention, the following is claimed:

1. A double-ended flex-handle wrench comprising:

a handle having a longitudinal axis, a pair of opposing forked arms connected by bridge means at each end thereof, and a pair of bulbous portions, each said bulbous portion positioned near one of said bridge means to provide additional ergonomic gripping surfaces for controlling and maneuvering said double-ended flex-handle wrench, at least one of each said pair of opposing forked arms and each said bridge means including a first part of a cooperating set of releasable locking means, said first part of said cooperating set of releasable locking means comprising:

a cavity, a ball means for engagement within said at least one cavity, and a bias means for biasing the ball means; and a pair of mounting means pivotable between the respective pair of opposing forked arms, said mounting means pivoting about an axis transverse to the longitudinal axis of the handle, and held by said ball means in a desired position relative to said handle, said mounting means comprising:

stud means for receiving a gripping means, said stud means comprising a retaining means including:

catch head means engageable with said gripping means, bias means for biasing the catch head means, and locking ball means engageable with said catch head means for releasably locking the gripping means to the mounting means, said catch head means including a recess means for receiving said locking ball means, said retaining means being in an unlocked position when said locking ball means is received by the recess means, and support means for supporting said stud means, said support means having a second part of said cooperating set of releasable locking means for cooperating with said first part for releasably holding said mounting means in a selected position, said second part including at least one cavity for receiving said first part of said cooperating set of releasable locking means.

2. A double-ended flex-handle wrench according to claim 1, wherein said bias means is comprised of a spring.

* * * * *